US012371240B2

(12) United States Patent
Bernstein et al.

(10) Patent No.: US 12,371,240 B2
(45) Date of Patent: Jul. 29, 2025

(54) INTEGRAL CARTON AND TRAY ARRANGEMENTS

(71) Applicant: WestRock Packaging Systems, LLC, Atlanta, GA (US)

(72) Inventors: Linda A. Bernstein, Lilburn, GA (US); John Valencia, Johns Creek, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 222 days.

(21) Appl. No.: 17/912,516

(22) PCT Filed: Mar. 17, 2021

(86) PCT No.: PCT/US2021/022660
§ 371 (c)(1),
(2) Date: Sep. 18, 2022

(87) PCT Pub. No.: WO2021/188607
PCT Pub. Date: Sep. 23, 2021

(65) Prior Publication Data

US 2023/0139262 A1 May 4, 2023

Related U.S. Application Data

(60) Provisional application No. 62/990,876, filed on Mar. 17, 2020.

(51) Int. Cl.
*B65D 77/04* (2006.01)
*B65D 5/42* (2006.01)
(Continued)

(52) U.S. Cl.
CPC ..... *B65D 77/0433* (2013.01); *B65D 5/425* (2013.01); *B65D 5/4266* (2013.01);
(Continued)

(58) Field of Classification Search
CPC ..... B65D 2205/00; B65D 51/1677; B65D 81/3453; B65D 5/563; B65D 5/4266;
(Continued)

(56) References Cited

U.S. PATENT DOCUMENTS 3,286,909 A * 11/1966 Scharre ..... B65D 77/0433 229/207
4,671,453 A * 6/1987 Cassidy ..... B65D 65/24 229/102
(Continued)

FOREIGN PATENT DOCUMENTS

WO 2012072086 A1 6/2012

OTHER PUBLICATIONS

PCT International Search Report and Written Opinion dated Feb. 6, 2021, issued during the prosecution of PCT International Patent Appliction No. PCT/US2021-022660.

*Primary Examiner* — Steven A. Reynolds
(74) *Attorney, Agent, or Firm* — Brian J. Goldberg; Rohini K. Garg

(57) ABSTRACT

A lidding device (102) includes a first panel (104) comprising a lid (106) configured to cover and seal a food container (108). A second panel (110) is foldably connected to the first panel. A third panel (112) includes a bottom panel opposite the lid, wherein the second panel is foldably connected to the first panel and the third panel. A fourth panel (114) is foldably connected to at least one of the first panel and the third panel, wherein the fourth panel and second panel are configured to at least partially enclose a food container between the second and fourth panels.

21 Claims, 15 Drawing Sheets

(51) Int. Cl.
*B65D 5/56* (2006.01)
*B65D 51/16* (2006.01)
*B65D 81/34* (2006.01)

(52) U.S. Cl.
CPC ..... *B65D 5/563* (2013.01); *B65D 51/1677* (2013.01); *B65D 81/3453* (2013.01); *B65D 2205/00* (2013.01)

(58) Field of Classification Search
CPC .. B65D 5/425; B65D 77/0433; B65B 7/2878; B65B 7/20
USPC ..... 206/524.1; 220/23.87; 53/477, 412, 411
See application file for complete search history.

(56) References Cited

U.S. PATENT DOCUMENTS 4,671,543 A 6/1987 Miliczky
4,962,849 A * 10/1990 Anderson ..... B65D 77/2096 229/123.1
5,423,449 A * 6/1995 Gordon ..... B65D 77/04 220/62.2
5,492,703 A * 2/1996 Gics ..... B65D 25/205 426/106
5,588,587 A * 12/1996 Stier ..... B65D 81/343 229/207
5,655,661 A * 8/1997 Rigby ..... B65D 1/36 229/209
5,743,402 A * 4/1998 Gics ..... B65D 25/205 229/87.08
5,839,574 A * 11/1998 Lorence ..... B65D 77/0433 426/112
2009/0078698 A1* 3/2009 Middleton ..... B65D 5/542 219/730
2013/0068653 A1* 3/2013 Lipinski ..... B65D 75/527 229/87.01
2014/0123607 A1* 5/2014 Valencia ..... B65D 51/1672 53/287

* cited by examiner

INTEGRAL CARTON AND TRAY ARRANGEMENTS

BACKGROUND

1. Field

The present disclosure relates generally to a three-panel or four-panel lidding device used to seal a food container.

2. Description of Related Art

Frozen foods are easy to store, transport, and serve. Other types of foods are also sold in stores as pre-prepared and ready for immediate cooking or microwaving. The packaging of these foods typically uses a clear plastic film that covers the food product inside the food container or bowl, as well as an outer package or box in which the food container is housed. In use, the consumer must open the box, cut or remove the plastic film in order to vent the food during cooking, cook/microwave the food, then discard the box and film. There are, however, instances when the film is not properly vented or when the user does not have the proper tool (e.g., knife or scissors) to vent the film, causing undesirable mistakes in the food cooking process. Providing both a plastic film and a packaging box also creates undesirable waste. Accordingly, improvements in the packaging of pre-prepared food products are desirable.

The conventional techniques have been considered satisfactory for their intended purpose. However, there is an ever present need for improved systems and methods for packaging food such as pre-prepared food products. This disclosure provides a solution for this need.

SUMMARY

The systems and methods described herein can be used to seal containers, such as for frozen food products, and to provide for handling the containers when open with hot foot products therein.

A lidding device includes a first panel comprising a lid configured to cover and seal a food container. A second panel is foldably connected to the first panel. A third panel includes a bottom panel opposite the lid, wherein the second panel is foldably connected to the first panel and the third panel. A fourth panel is foldably connected to at least one of the first panel and the third panel, wherein the fourth panel and second panel are configured to at least partially enclose a food container between the second and fourth panels.

The food container can be sealed to the first panel, wherein the food container is at least partially enclosed between first panel and the third panel and between the second panel and the fourth panel. An insulation space can be defined between the food container and at least one of the first, second, third, and fourth panels. Side flaps foldably connected to at least one of the first and third panels configured for adhering the first panel to the third panel. The first panel, second panel, third panel, fourth panel, and side flaps can completely enclose the food container. It is also contemplated that two opposed panels can be foldably connected to the first, second, third, and fourth panels, wherein each of the two opposed panels includes a cutout which receives a respective edge of the food container.

The first panel can include a venting system including one or more lines of weakness along an edge of the first panel for venting the first panel. The first panel can include a pull tab for peeling back the first panel along one or more lines of weakness along the first panel edges. The second panel can be configured for use as a foot that allows the lidding device to stand upright on the second panel. At least one of the panels can be configured to be printable for printing product identifying material or instructions thereon. At least the first panel can comprise a thermoplastic or heat sealable coating applied to food-facing side of the panel. The thermoplastic coating can comprise a polyolefin dispersion or a polymeric-based film.

A method of forming a lidding device includes providing a printable or pre-printed paperboard material, forming a multi-panel blank from the paperboard material, wherein the panels are separated via lines of weakness, and applying a thermoplastic heat seal coating to at least a portion of one side of the blank. The method includes fitting the blank around a container to surround the container between at least a top panel and an opposed bottom panel and between a first side panel and an opposed second side pane and heat sealing the thermoplastic heat seal coating to the container.

The method can include applying one or more coatings to the paperboard material. The one or more coatings can comprise a clay coating. Applying one or more coatings can comprise applying a thermoplastic heat seal coating to at least a portion of one side of the blank. The paperboard material can be pre-printed with marketing graphics with heat resistant microwaveable inks and/or overprint. Fitting the blank around the container can include completely surrounding the container inside the blank. Fitting the blank around the container can include protruding two edges of the container through cutouts in opposed flaps of the blank. Fitting the blank around the container can include forming at least one insulation space between the container and the panels of the blank.

A lidding device includes a food container and a paper container sealed to the food container. The paper container surrounds the food container on at least three or four sides of the food container. There is an insulation space defined between the food container and the paper container.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
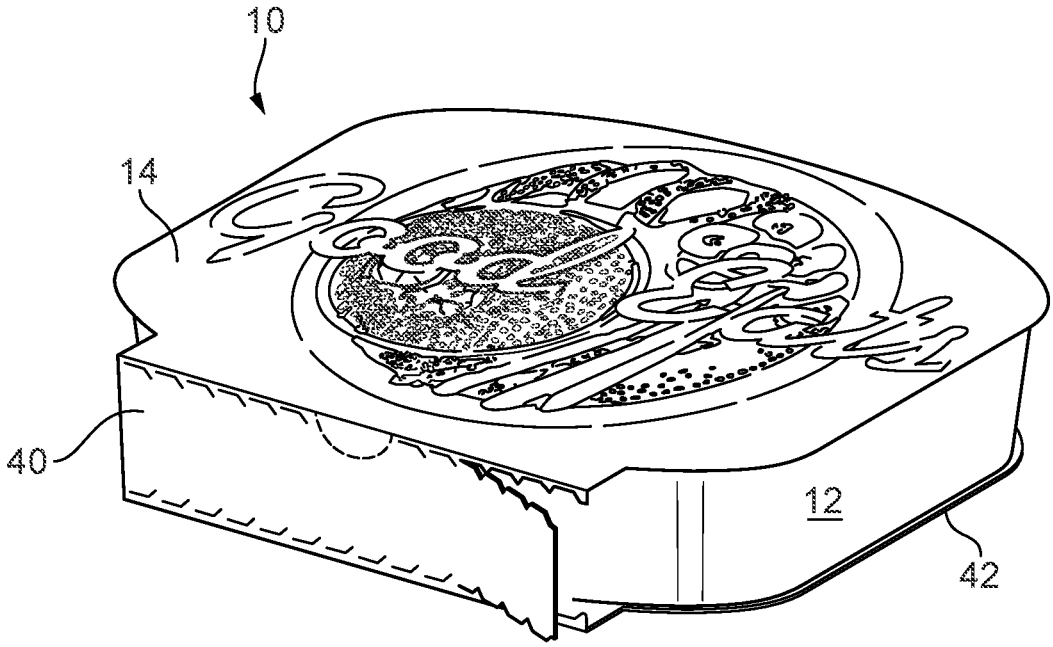
FIG. 1 shows a top perspective view of a lidding device in place on a food container.

Reference will now be made to the drawings wherein like reference numerals identify similar structural features or aspects of the subject disclosure. For purposes of explanation and illustration, and not limitation, a partial view of an embodiment of a blank for a lidding device in accordance with the disclosure is shown in FIG. 1 and is designated generally by reference character 10. Other embodiments of systems in accordance with the disclosure, or aspects thereof, are provided in FIGS. 2-22, as will be described. The systems and methods described herein can be used to seal containers, such as for frozen food products, and to provide for handling the containers when open with hot foot products therein.

The figures illustrate various embodiments of a lidding device 10. As shown in the Figures, the lidding device 10 comprises three panels: a first panel 14 separated from a third panel 42 by a second panel 40. Any of the panels may include marketing materials, product identifiers and information, or graphics. The first panel 14 forms a lid that covers and seals the contents of a food container 12. The second panel forms a foot 46 that is useful for display purposes. The third panel 42 provides a base panel.

A thermoplastic or heat seal coating may be applied to the food-facing side of the first panel 14, which is the side that interacts with the container 12 to seal the contents of the container. The heat-seal coating is applied at suitable places around the panel. This coating also acts as a barrier to protect the lid from water/oils in the product(s) stored in the container. In some embodiments, the thermoplastic coating is a polyolefin dispersion, although other water or solvent-based coatings that provide a suitable seal between the device and the container may be used. For example, polymeric based films, which may be adhesively laminated to the paperboard blank or directly extrusion coated to the blank, may be used. In some embodiments, the heat sealable coating is applied to the underside of substantially the entirety of the first panel 14 so that it faces and covers/seals the contents of the container. In some cases, the coating consists of a heat sealable adhesive that is applied to the paperboard blank as part of production before the blank is cut, and in other cases is applied afterwards. The coated paperboard is configured to withstand a range of environmental conditions relating to manufacture, transportation, storage (which may include freezing), sale, and use of the product, which may include defrosting and/or heating (such as by microwave oven, conventional oven, convection oven, and/or toaster oven) of the product stored within the food container. The coated paperboard is also configured to be safe for contact with food products in compliance with 21 CFR 176.170.

One specific embodiment of a lidding device 10 that is useful for covering and sealing a food product container 12 is illustrated by FIG. 1. Appropriate food product containers 12 are typically made of plastic, but may be made of any appropriate material that can house and store food, and that also allow the food to be cooked therein. Such containers are commonly recognizable as the type of containers that are used for microwavable food products, but they may also be used in conventional ovens, toaster ovens, or convection ovens.

The lidding device 10 that is used to cover and protect the food contained in the container 12 is typically made of paperboard, but may be made of any printable, foldable, fiber-based substrate. In a particular embodiment, the lidding device 10 is made of a two-sided clay coated SBS (Solid Bleached Sulfate) having an appropriate coating as described above applied thereto, although it should be understood that any food-safe lidding material may be used.

Figure 2:
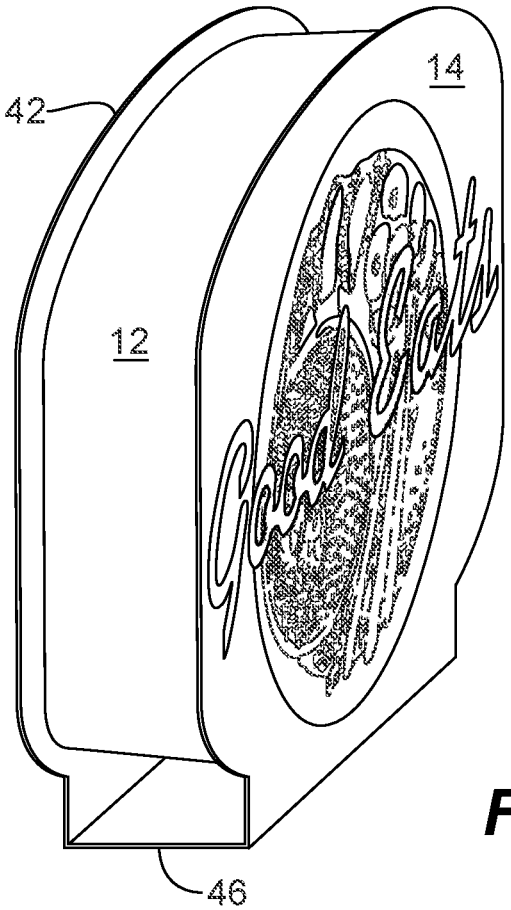
FIG. 2 shows the device of FIG. 1 standing on its foot panel.

The lidding device 10 provides a three-panel system that covers the top and bottom of the food container 12, as well as provides a side panel that functions as a connecting panel, which also provides a display function. As shown in FIG. 2, a first panel 14 is provided to form the cover or lid panel of the lidding device. The first panel may have an opening feature that allows for venting during the heating process. For example, first panel may have a venting system 20, as will be described in more detail with respect to further figures, and venting system 20 maybe provided in a number of ways. For example, the venting and/or opening feature may include lines of weakness that are configured to be broken and/or removed or displaced to provide ventilation. Optionally, a pull-tab or tear strip adjacent the opening feature may be used to move the opening feature into its vent position.

Figure 3:
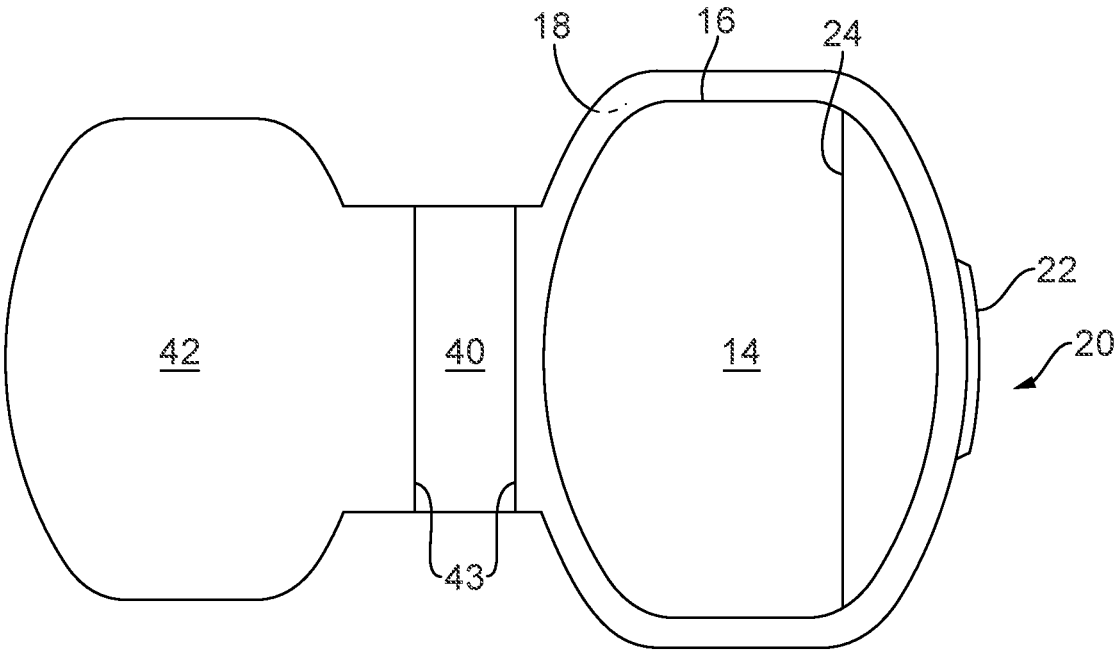
FIG. 3 shows a top plan view one embodiment of a blank that may be used to form lidding device.
Figure 4:
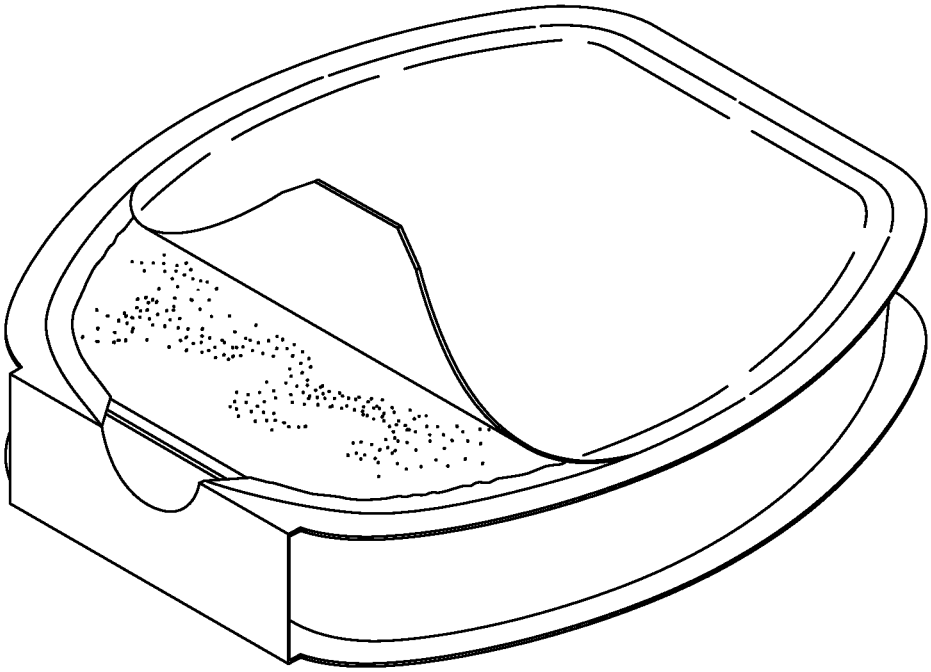
FIG. 4 shows a side perspective view of one embodiment of how a lidding device may be opened to vent food and to remove the lid panel.

Specifically, as shown in FIG. 3, first panel 14 has one or more lines of weakness 16 provided along its edge areas 18, which allows the first panel 14 to be removed before, during and/or after the cooking process. Lines of weakness 16 may be provided as perforations, score lines, partial cuts, reverse partial cuts, or any other feature that allows the first panel 14 to be broken, removed or displaced upon application of the appropriate amount of pressure. These lines 16 may assist with the venting, but they may also be used to remove the entire lid panel 14 from the container 12, as shown in FIG. 4.

Figure 5:
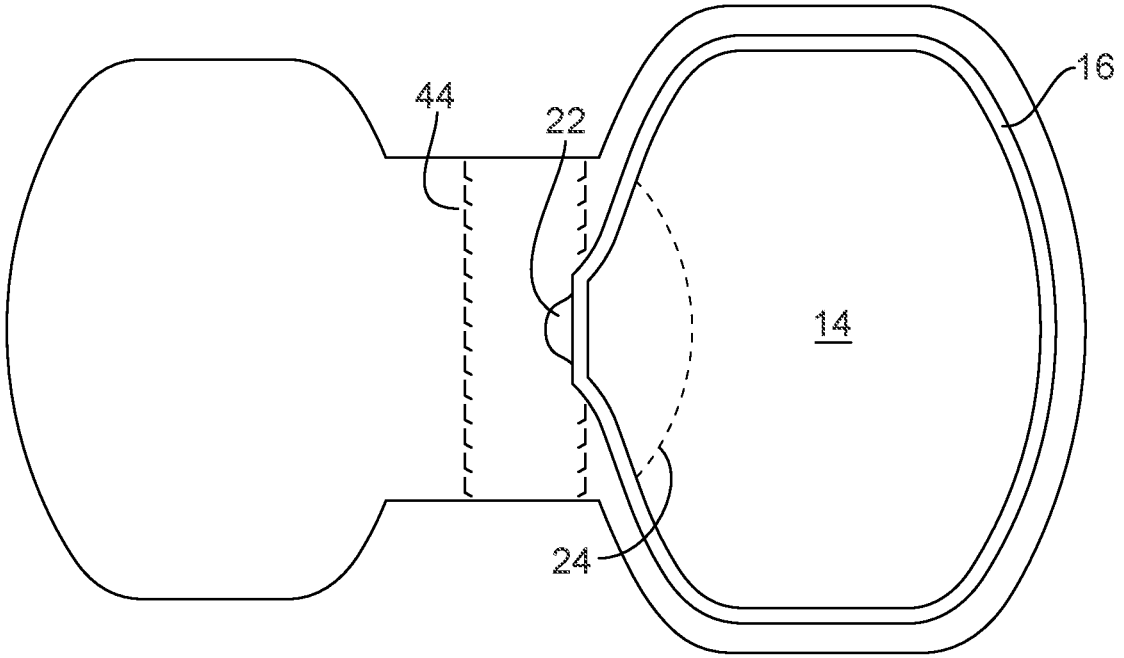
FIG. 5 shows a top plan view of an alternate blank that may be used to form a lidding device.
Figure 6:
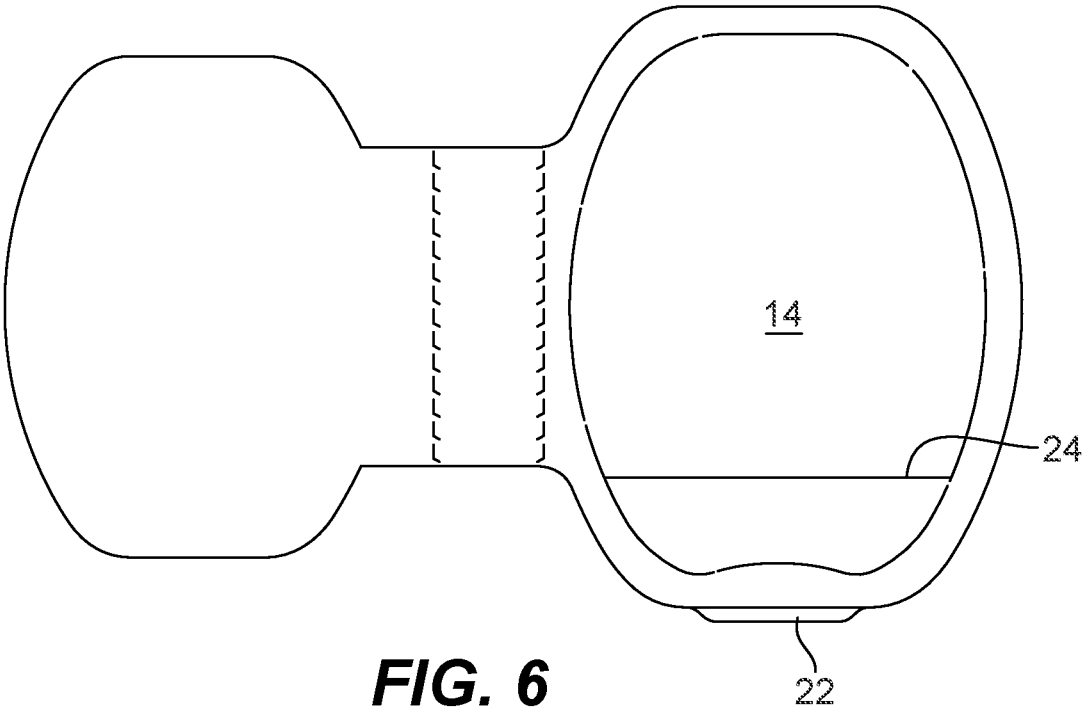
FIG. 6 shows a top plan view of a further alternate blank that may be used to form a lidding device.
Figure 7:
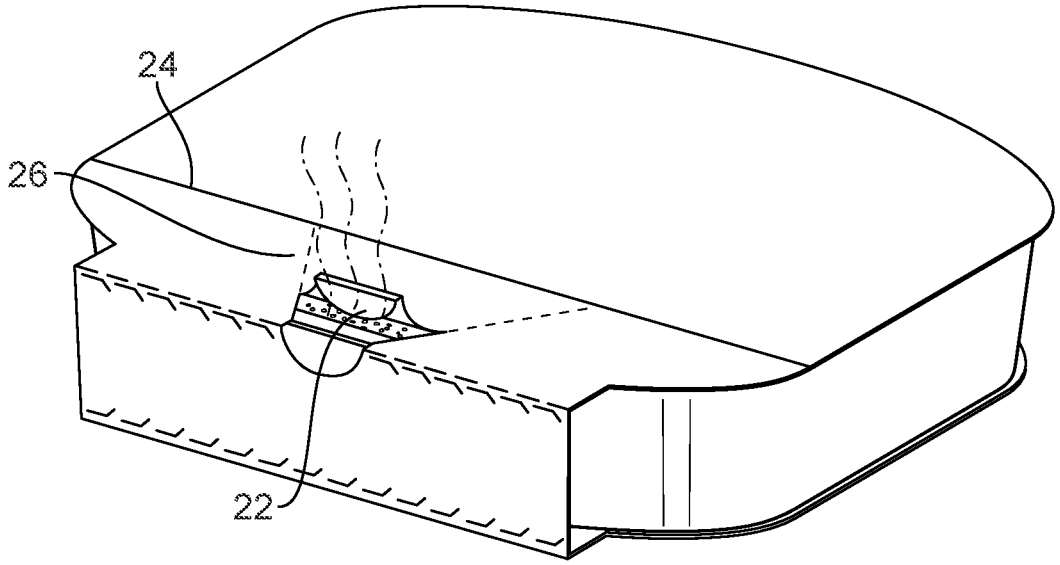
FIG. 7 shows a side perspective view of an alternate embodiment of a lidding device being vented.

FIG. 3 also shows an embodiment of a venting system 20 that is created via cooperation between a pull tab 22 and a score line 24. In use, the user grasps pull tab 22 and pulls a portion of the panel lid 14 back to the area where the score line 24 is located in order to create an opening in the panel lid 14. The pull tab 22 is generally located near the side of the panel where the venting score line 24 is located. The pull tab 22/score line 24 system may be provided near the right side of the panel 14 (FIG. 3), along the left side of the panel 14 (FIG. 5) or along the top (or bottom) of the panel 14 (FIG. 6). Pull tab 22 may be any appropriate shape, such as a rectangular tab (FIGS. 3 and 6) or a rounded protrusion (FIG. 5). As the edge portion of the panel lid is pulled back, the lines of weakness 16 that secured the lid in place are disrupted, and they allow a peeling back of the lid portion to the score line 24. It is also possible to create further lines of weakness 26 that extend between the tab 22 and the score line 24, in order to further ease the peeling back of the lid, if desired or necessary.

Figure 8:
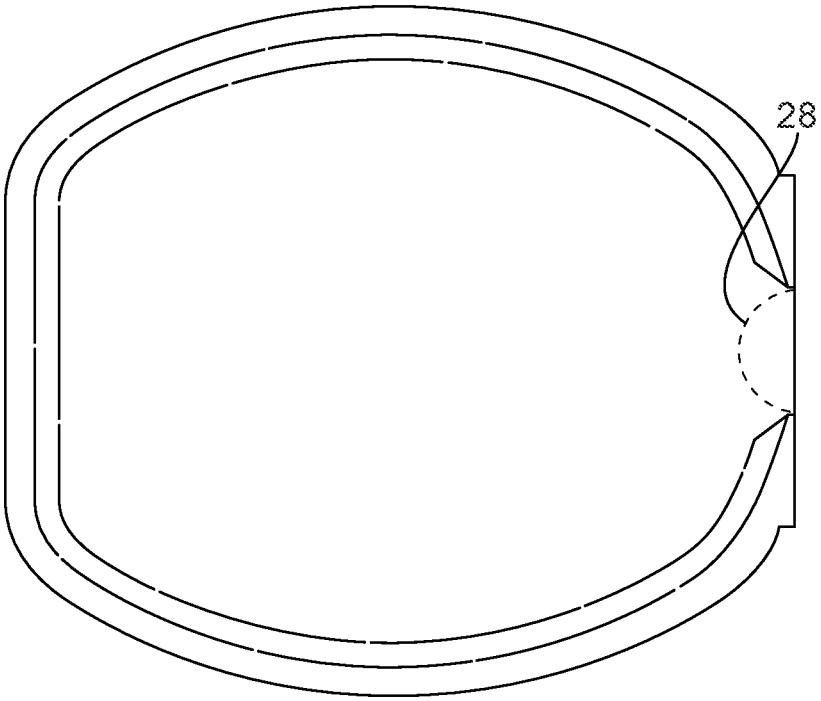
FIG. 8 shows a top plan view of a lidding device in place on a food container, the lidding device having a perforation for its venting system.
Figure 9:
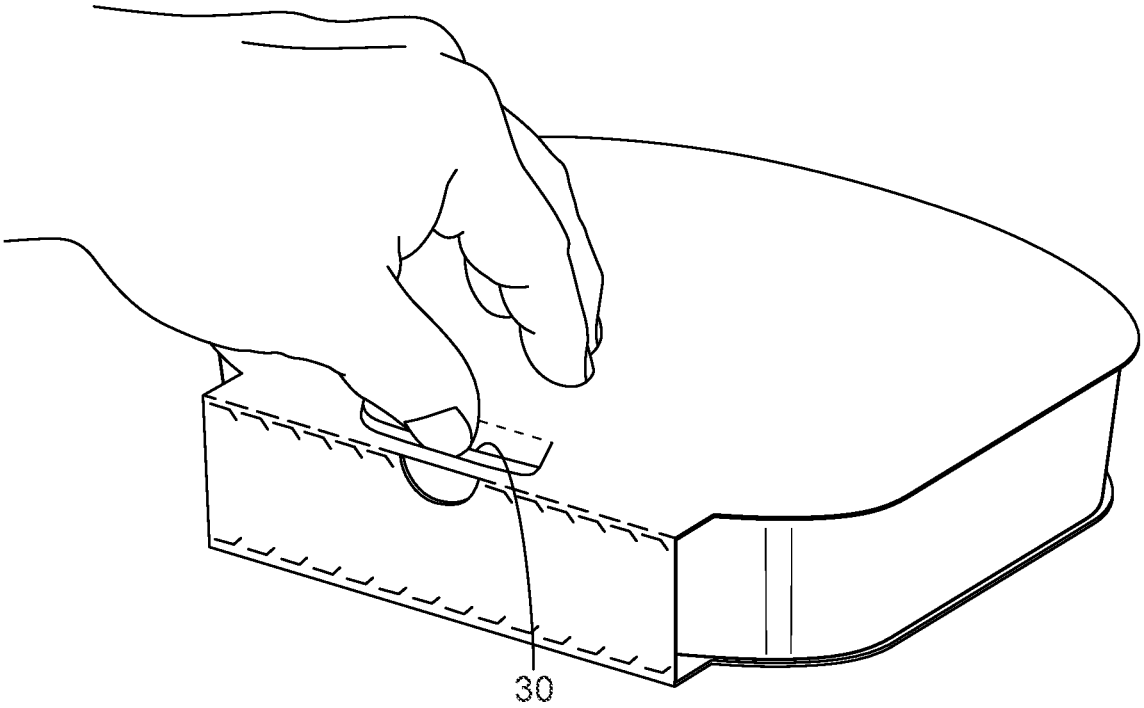
FIG. 9 shows a side perspective view of an alternate venting system for a lidding device.

In an alternate embodiment, no tab is required, but a line of weakness 28 is provided as the venting system 20, as shown in FIG. 8. In use, finger pressure may be used along the venting line of weakness 28 to create the desired opening. This line of weakness 28 may be formed as a shape 28 that could be peeled back or punched out/removed completely, as shown in FIG. 8. Alternatively, this portion may be provided as a single perforated line 30 that is punctured to create a venting slit or hole, as shown in FIG. 9.

Figure 10:
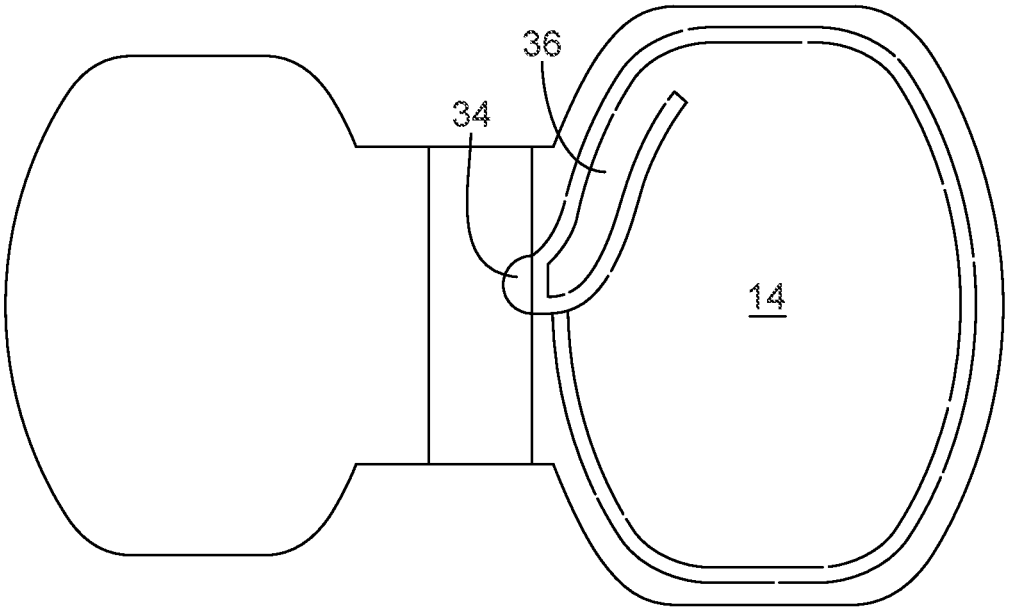
FIG. 10 shows a top plan view of one lidding device blank that has a tear strip feature.
Figure 11:
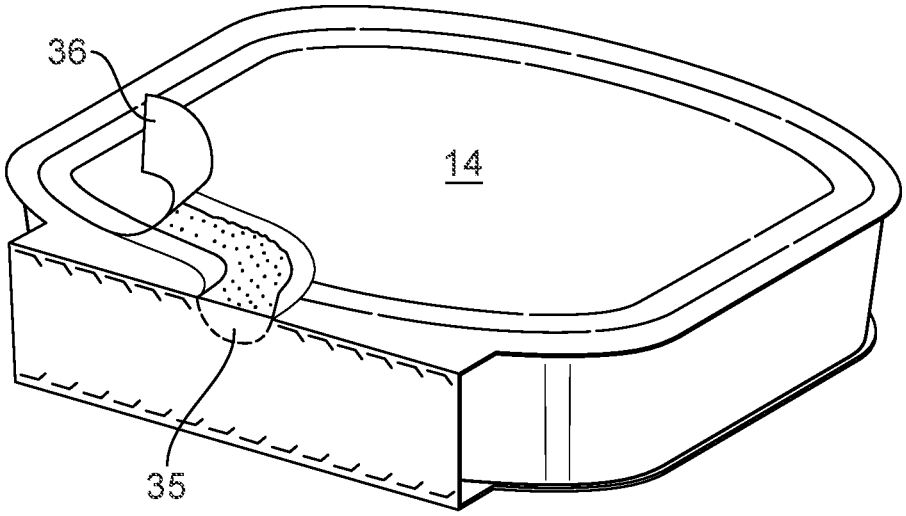
FIG. 11 shows a side perspective view of a lidding device with an alternate tear strip feature being vented.

In a further embodiment, a pull open tear strip 36 may be provided, as shown in FIG. 10. The pull open tear strip 32 features a thumb tab 34 connected to a tear strip feature 36 that travels along an edge of the panel lid 14. In an alternate embodiment as shown in FIG. 11, instead of a thumb tab, there is a puncturable/covered opening 35 provided in the lid where a thumb may punch out the removable portion, insert a thumb, and grasp the tear strip feature 36.

Figure 13:
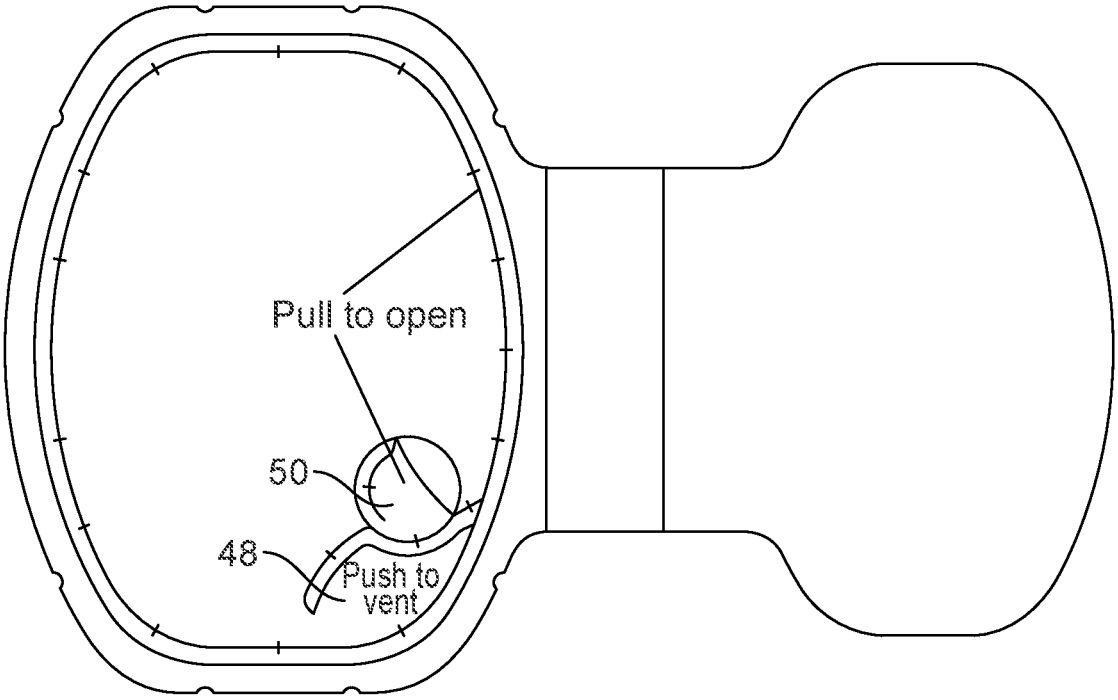
FIG. 13 illustrates top plan view of a blank that has a push to vent feature.
Figure 14:
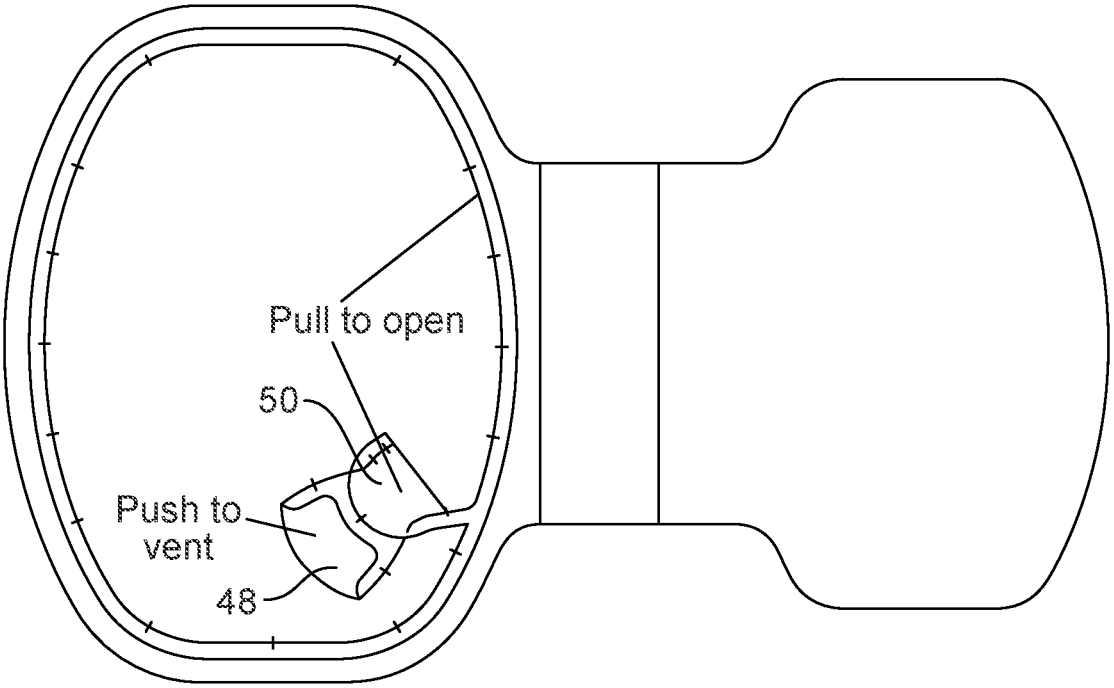
FIG. 14 illustrates top plan view of a blank that has an alternate push to vent feature.
Figure 15:
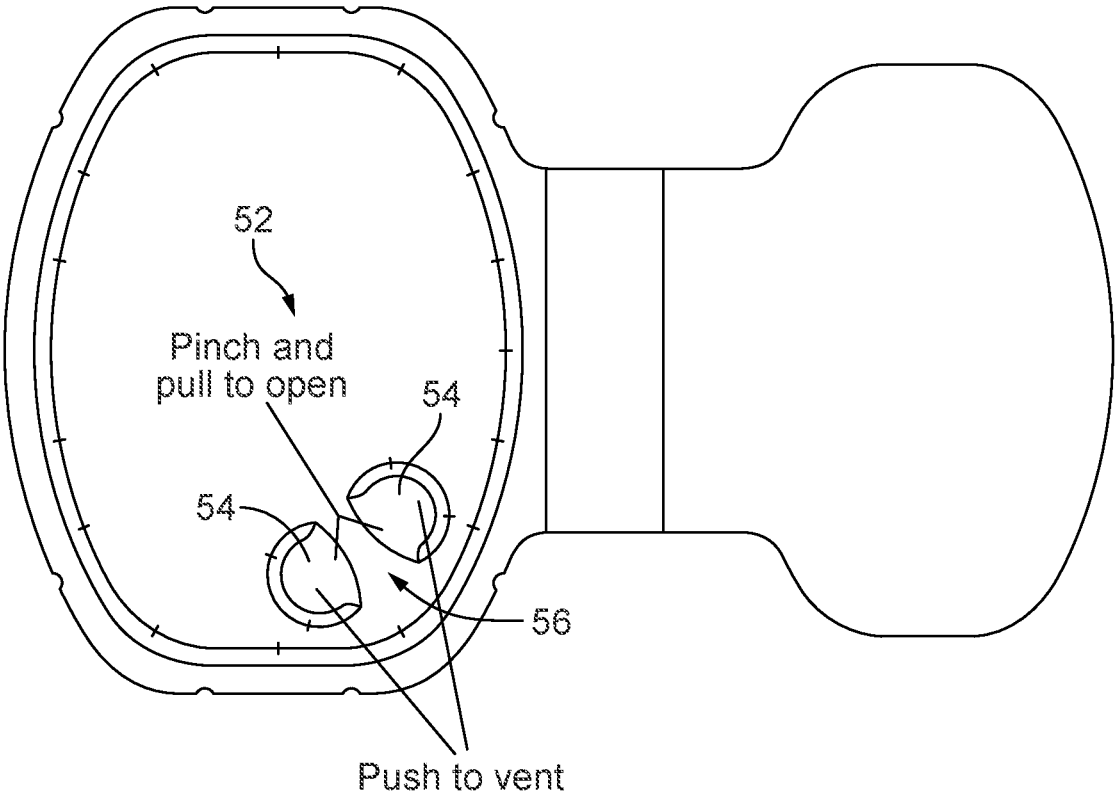
FIG. 15 illustrates top plan view of a blank that has a push to vent and pinch to pull and open feature.

In a further embodiment, there may be provided a push to vent feature in the lid. One embodiment of a simple push to vent feature is shown in FIG. 9, where the opening 30 is created by thumb pressure along the perforated line. More fully developed embodiments of push to vent features are shown in FIGS. 13-15. For example, FIG. 13 shows a push to vent feature 48 which is adjacent to a pull to open feature 50. The user may press at the push to vent 48 portion in order to create a venting area. Once the cooking/heating process has been completed, the user may then grasp the pull to open portion 50 to remove the lid from the food container.

An alternate embodiment of a push to vent feature is shown in FIG. 14. This figure illustrates back-to-back push to vent 48 and pull to open 50 areas. A further embodiment provides a pinch to open feature 52, as shown in FIG. 15. In this embodiment, two push to vent features are provided as semi-circles 54 formed as perforations in the lid. After the semi-circles 54 are pressed in for venting during cooking/heating, they may be used to pinch the lid to open. The space 56 between the semi-circles creates somewhat of a handle for the user to raise the lid.

Although a number of alternate embodiments for venting system are shown and described, it should be understood that any configuration that provides a venting system may be used in connection with the three-panel lid disclosed herein. Regardless of the embodiment provided, upon appropriate pressure or pulling at the venting system 20, the first panel 14 opens or separates from the container 12, allowing air to vent into and from the food container during cooking. In some embodiments, the first panel is removed before serving and consumption. Once the food has cooked completely, the entire panel lid 14 may be removed, as shown in FIG. 4. The edge lines of weakness 16 may assist with this removal.

Figure 12:
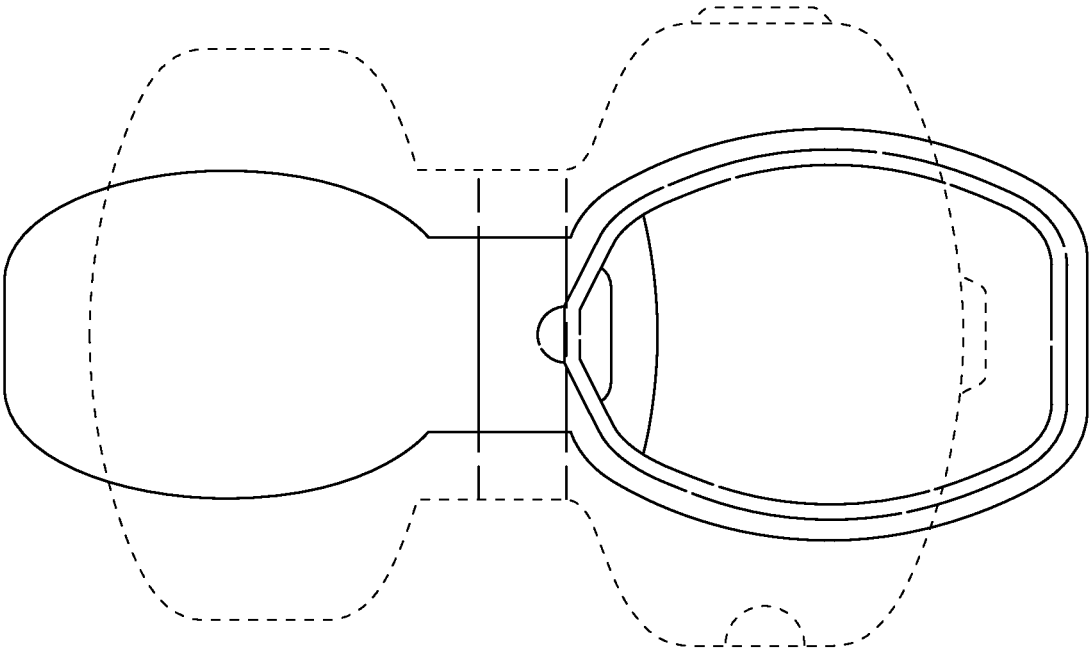
FIG. 12 illustrates that any number of lidding device configurations may be used, with various tabs at various locations and various perforation/score line locations.

FIG. 12 illustrates that alternate shapes and sizes for the panels may be provided, depending upon the shape and size of the container to be lidded. In general, however, the first panel 14 is generally shaped to cover a food product container 12, albeit slightly larger than the opening of the container so that the entire opening of the container 12 is covered. The tabs may be positioned at any appropriate location, the score lines may be interchanged for perforations and vice versa, and alternate venting systems may be provided.

Reference is now made back to FIGS. 3, 5, 6, 8, and 12, which show embodiments of the lidded device blank prior to its being folded, shaped, and enclosing a container 12. A second panel 40 is connected to the first panel 14. As shown in FIG. 3, second panel 40 is positioned between and separates the first panel 14 and the third panel 42. The connection areas are generally via either score lines 43 or small cuts or perforations 44 in the blank that allow easy removal of the second panel 40 from the first and third panels 14, 42 in use. Although score lines 43 are shown in some figures are perforations 44 in others, it should be understood that these features may be interchangeable and/or used collectively.

The second panel 40 generally forms a side or bottom panel (depending upon how the device 10 is positioned). In some embodiments, the second panel is configured to serve as a foot 46 that keeps the bowl upright, as shown in FIG. 2. Once the lidded device 10 is folded and positioned with respect to a food container 12, the foot 46 can be used to allow the device 10 to stand thereon, such that the device can be easily stacked in a freezer, refrigerator, or shelf section, while still displaying the package printing and taking up less space than if the containers were stacked vertically.

Any or all of the panels have at least one (or both) side(s) that are configured to be printable for printing product identifying material and/or instructions thereon. For example, the non-food facing side of the first panel 14 generally contains brand and product messaging or images, while additional information, such as a list of ingredients and cooking and/or opening instructions, may be included on another panel, such as the second and/or or third panels.

Also disclosed is a method of forming a lidding device. In one embodiment, the device may be formed using standard paperboard forming machinery to form a die-cut blank, having various lines of weakness, such as score lines and/or perforations, positioned thereon. A clay coating is then applied to the blank. Next, the suitable thermoplastic heat sealcoating is applied to one side of the blank, which will generally be the food-facing side of at least the first panel 14. Alternatively, the thermoplastic heat seal coating may be applied during manufacture of the paperboard out of which the blank is cut. The paperboard may be printed with heat resistant microwaveable inks and/or overprint. Moreover, the blank used to form the lidding device may be die cut to a customer's specifications, depending upon the shape of the food container to be covered and sealed.

In use, the container 12 is filled with food (or other product) and the lidding device 10 is folded and formed from the blank and wrapped around the container 12. Heat sealing equipment may then be used to activate the heat sealable coating to bind the paperboard to the container. In other embodiments, ultrasonic or radio frequency sealing technology may be used to activate the heat sealable coating. This may be done using any suitable machinery or method.

The blank 100 for a lidding device 102 (shown in FIG. 17 erected from the blank 100 of FIG. 16) includes a first panel 104 comprising a lid 106 configured to cover and seal a food container 108. A second panel 110 is foldably connected to the first panel 104. A third panel 112 includes a bottom panel opposite the lid 106 when the blank is erected as shown in FIG. 17. The second panel 110 is foldably connected between the first panel 104 and the third panel 112. A fourth panel 114 is foldably connected the third panel 112, and a fifth panel 116 is foldably connected to the first panel 104. When the blank 100 is erected as shown in FIG. 17, the fourth and fifth panels 114 and 116 are adhered together to form a single panel that is opposite the second panel 110 for at least partially enclosing the food container 108 between the second and fourth panels 110, 114.

Figure 16:
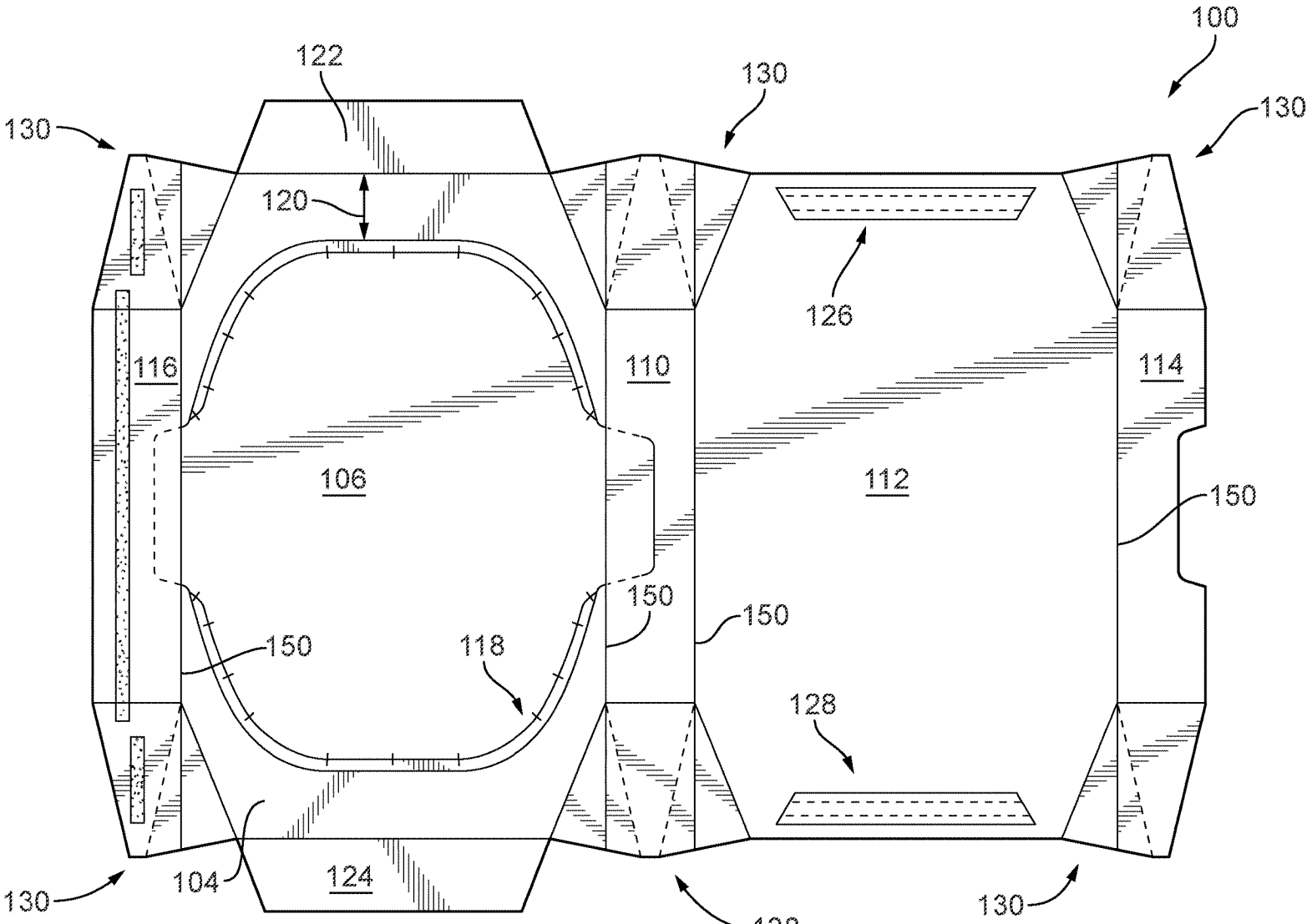
FIG. 16 is a plan view of an embodiment of a blank for a lidding device constructed in accordance with the present disclosure, showing the panels and flaps.
Figure 17:
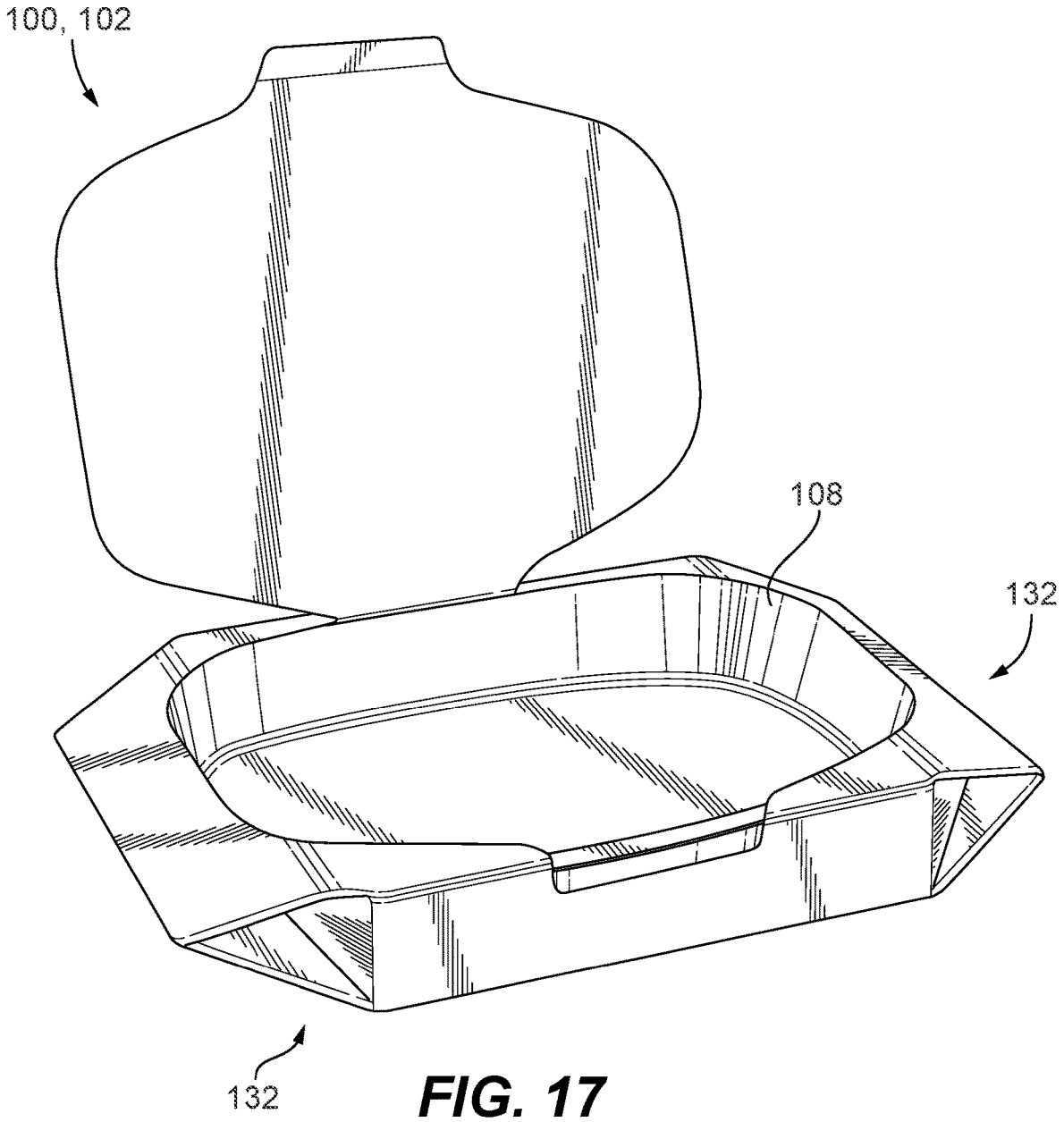
FIG. 17 is a perspective view of the lidding device of FIG. 1, showing the flaps and panels enclosing a food container.
Figure 18:
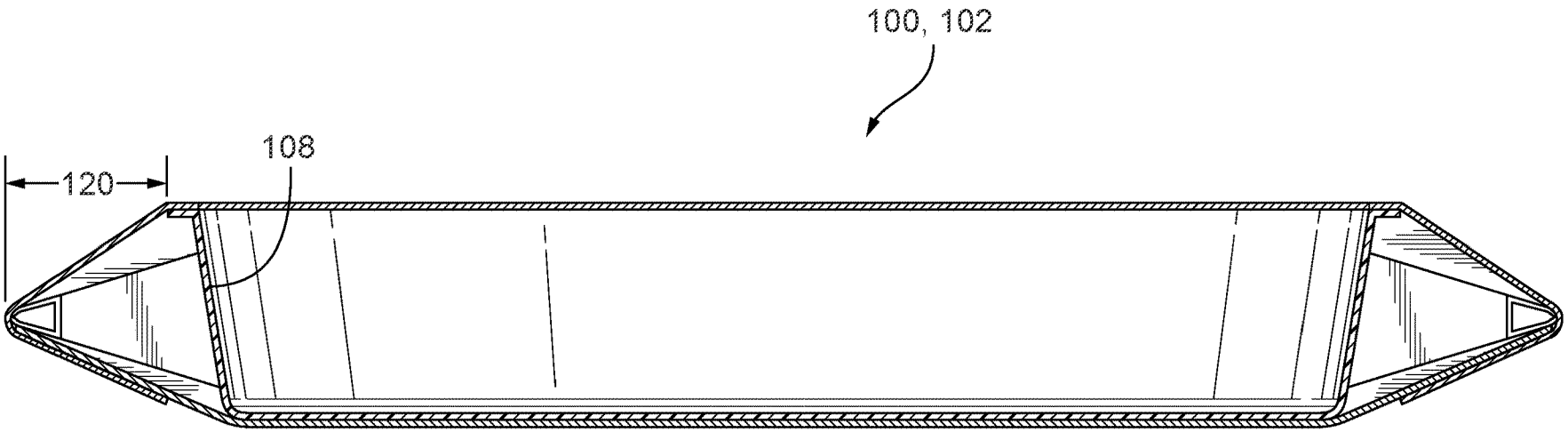
FIG. 18 is a cross-sectional side elevation view of the lidding device of FIG. 2, showing the insulation space between the food container and the flaps and panels.

With continued reference to FIGS. 16 and 17, the food container 108 is sealed to the first panel 104 around a sealing perimeter 118 around the lid 106. The food container 108 enclosed between first panel 104 and the third panel 112, as well as between the second panel 110 and the fourth panel 114. An insulation space 120 (identified in FIGS. 16 and 18) is defined between the food container 108 and each of the first, second, third, and fourth panels 104, 110, 112, 114. Side flaps 122, 124 are foldably connected to at least one of the first and third panels 104, 112 configured for adhering the first panel 104 to the third panel 112 (e.g. by adhering the flaps 122, 124 to the respective sections 126, 128 of the third panel 112. The corner sub-panels 130 of the first, second, third, fourth, and fifth panels 104, 110, 112, 114, 116 are used to form the recessed corners 132 when the blank 100 is erected as shown in FIG. 17. The first panel 104, second panel 110, third panel 112, fourth panel 114, and side flaps 122 completely enclose the food container 108. The blank 100 thus forms a paper container in a lidding device that includes the food container 108. The paper container surrounds the food container 108 on at least four sides of the food container, and there is an insulation space 120 is defined between the food container 108 and the paper container.

Figure 19:
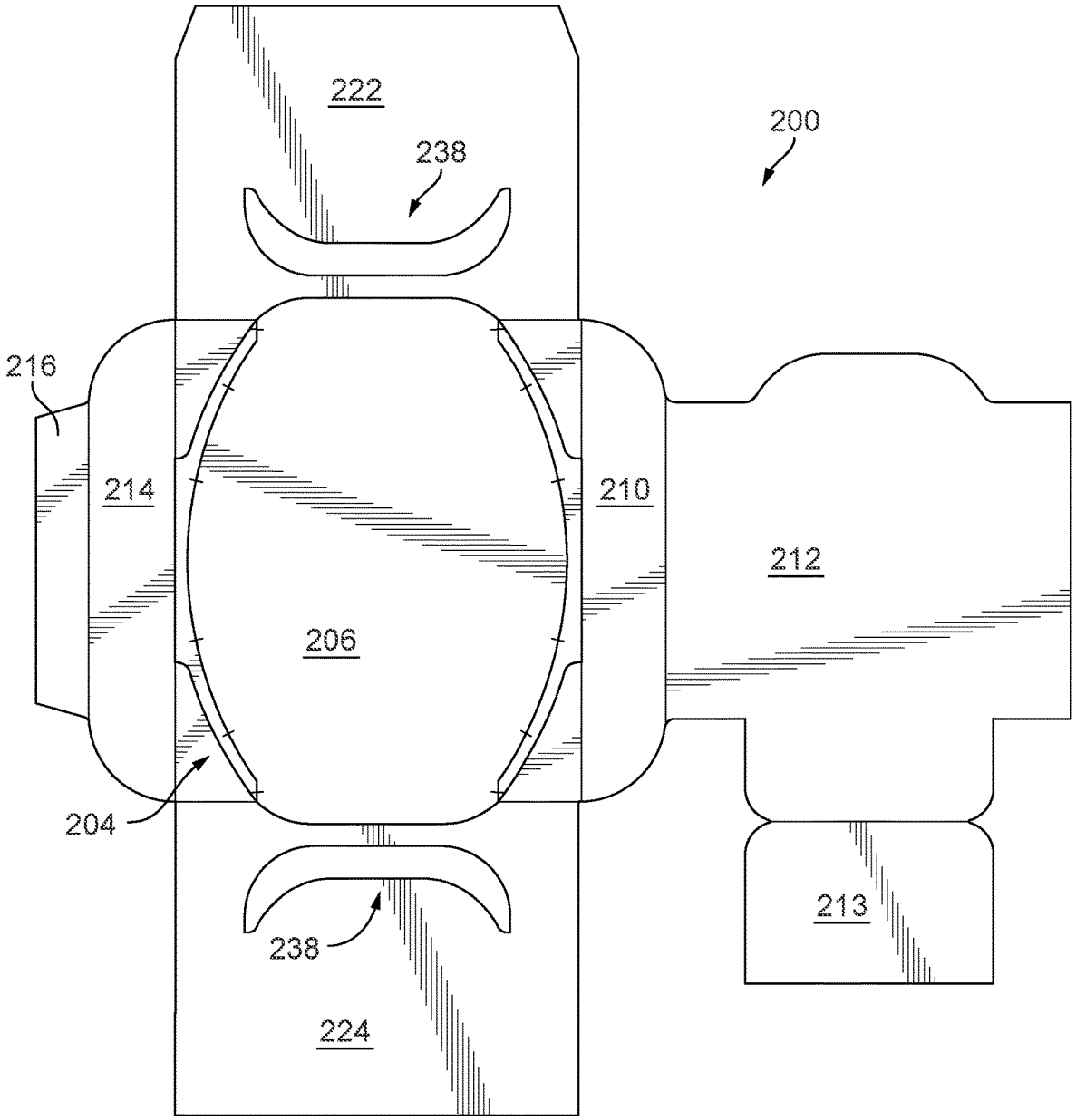
FIG. 19 is a plan view of another exemplary embodiment of a blank for a lidding device, showing the panels and flaps.
Figure 20:
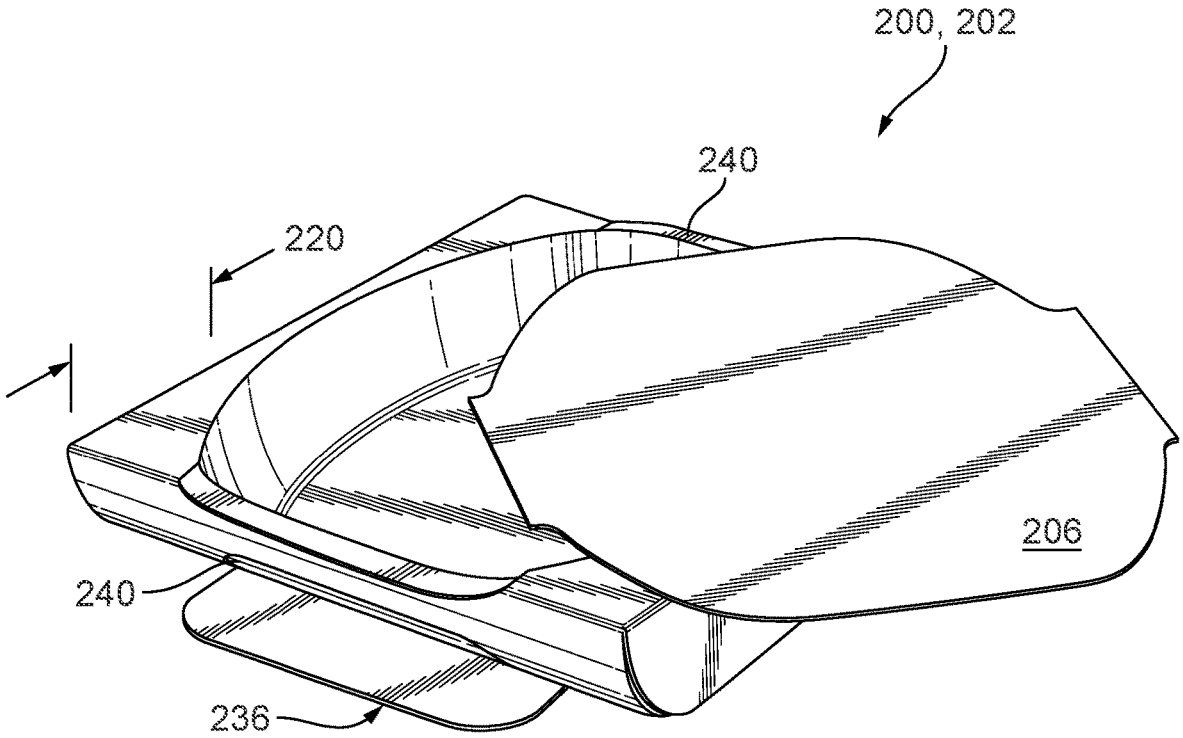
FIG. 20 is a perspective view of the lidding device of FIG. 4, showing the flaps and panels at least partially enclosing a food container.
Figure 21:
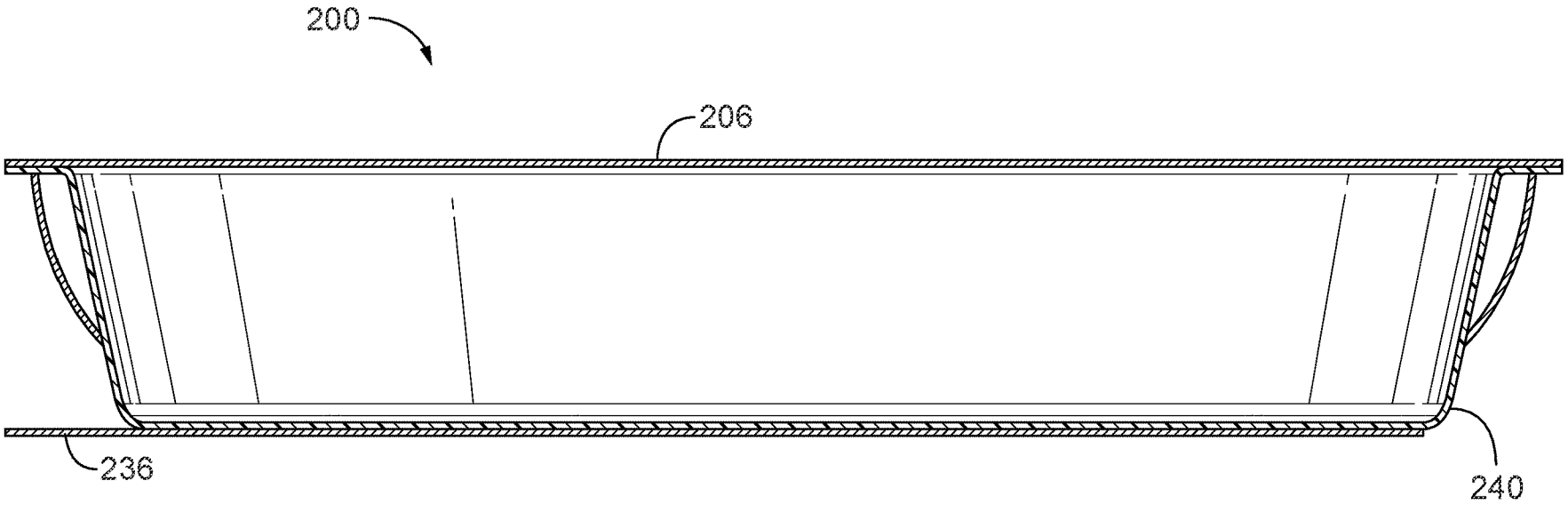
FIG. 21 is a cross-sectional side elevation view of the lidding device of FIG. 5, showing the insulation space between the food container and the flaps and panels.

With reference now to FIGS. 19-21, another embodiment of a blank 200 and lidding device 202 is shown. A first panel 204 defining a lid 206 is foldably connected to a second panel 210, which is foldably connected to a bottom or fourth third panel 212. A fourth panel 214 is foldably connected to the first panel 204 and can be connected to the third panel 212 adhering the adhesive flap 215 (that is foldably connected to the fourth panel 214) to the third panel 212 to erect the blank 200 into the lidding device 202 of FIG. 20. The reinforcement flap 213 is foldably connected to the third panel 212 to form a foot 236 that can be used to stand the lidding device 202 upright relative to the position shown in FIG. 20. Two opposed panels 222, 224 are each foldably connected to the first, second, third, and fourth panels 204, 210, 212, 214 (i.e. the panels 222, 224 are foldably connected directly to the first panel 104. Each of the two opposed panels 222, 224 includes a respective cutout 238, which receives a respective protruding corner or edge 240 of the food container 208 extending therethrough. The insulation space 220 is provided in the corners of the lidding device. The insulation spaces 120, 220 allow for handling the lidding devices 102, 202 when hot, e.g., after microwaving the food contents, a user can handle the lidding devices 102, 202 by grabbing the lidding device 102, 202 proximate the insulation space 120, 220.

Figure 22:
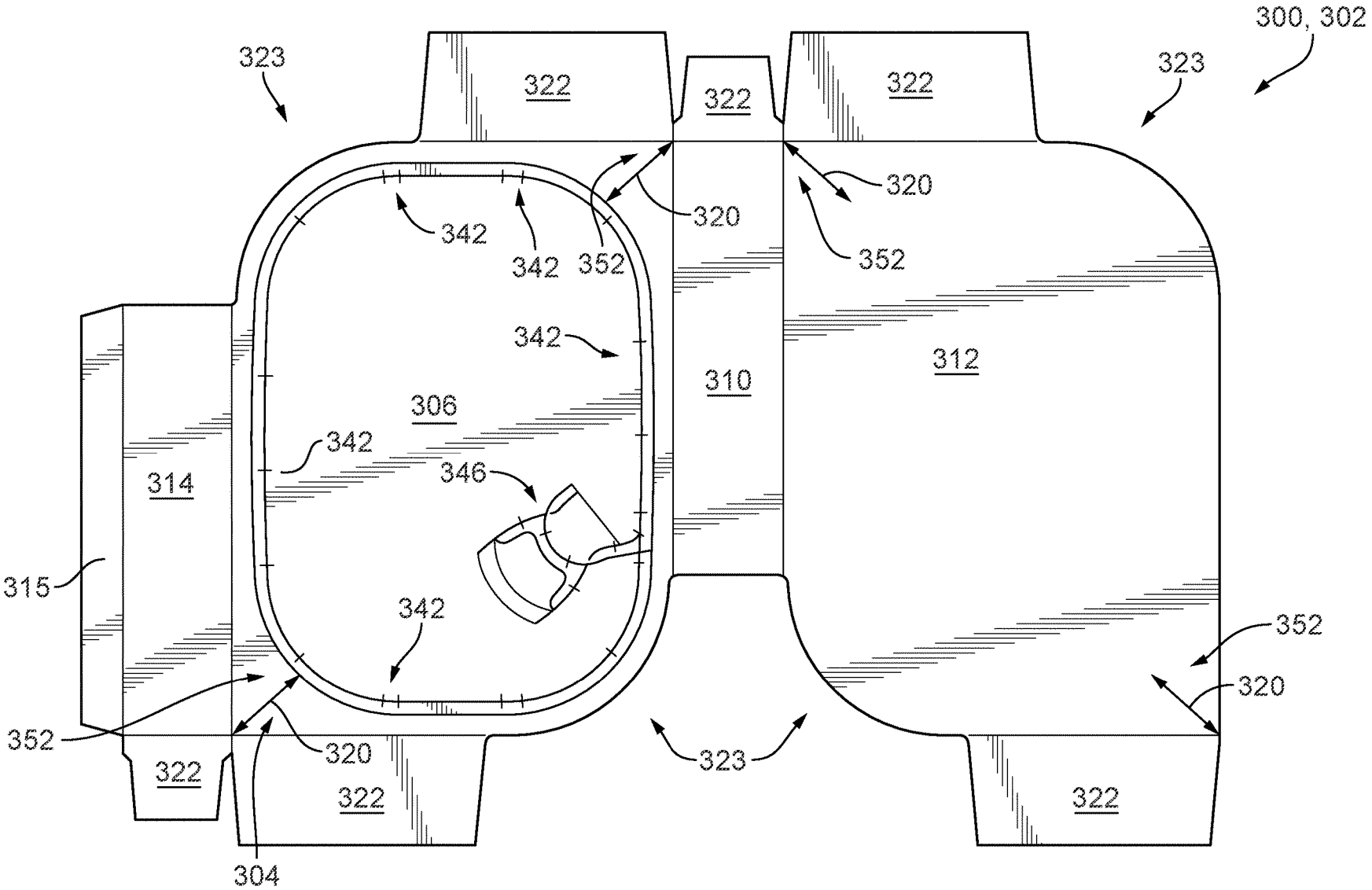
FIG. 22 is a plan view of another exemplary embodiment of a plank for a lidding device, showing a venting system and pull tab.

With reference now to FIG. 22, another blank 300 is shown, including first, second, third, and fourth panels 304, 310, 312, 314 similar to those described above with respect to blank 200. The lid 306 can be adhered to a food container (such as food containers 108, 208) and the blank 300 can be erected around the food container, adhering the adhesive flap 315 to the third panel 312 much as described above with reference to FIGS. 19-21. Flaps 322 can be overlapped and adhered together to partially enclose opposed ends of the food container (e.g. food container 108 and 208). Corner regions 323 are left open, not fully enclosing the food container, and corners 352 provide the insulation space 320 much as described above with respect to blanks 100, 200. The first panel 304 includes a venting system including one or more lines of weakness 342 along an edge of the first panel 304 for venting the food container, e.g. during cooking. The first panel 304 includes a pull tab 346 for a user to use in peeling back the lid 306 of the first panel 304 along one or more lines of weakness along the first panel edges. Blanks 100, 200 described above can have similar venting systems and pull tabs.

In any of the blanks 100, 200, 300, at least one of the panels can be configured to be printable for printing product identifying material or instructions thereon. At least the first panel of the blanks 100, 200, 300 can comprise a thermoplastic or heat sealable coating applied to food-facing side of the panel, and the thermoplastic coating can comprise a polyolefin dispersion or a polymeric-based film.

A method of forming a lidding device (e.g. lidding device 102, 202, 302) includes providing a printable or pre-printed paperboard material, forming a multi-panel blank (e.g. blanks 100, 200, 300) from the paperboard material, wherein the panels (e.g. panels 104, 110, 112, 114) are separated via lines of weakness (e.g. fold lines 150 shown in FIG. 16), and applying a thermoplastic heat seal coating to at least a portion of one side of the blank. The method includes fitting the blank around a container (e.g. food container 108, 208) to surround the container between at least a top panel and an opposed bottom panel and between a first side panel and an opposed second side pane and heat sealing the thermoplastic heat seal coating to the container. Three-sided embodiments, e.g., as in FIG. 1, are wrapped around the respective tray, and the four-sided embodiments, e.g. FIG. 16, can have the tray inserted in a form/fill/seal operation.

The method can include applying one or more coatings to the paperboard material. The one or more coatings can comprise a clay coating. The applying the one or more coatings can comprise applying a thermoplastic heat seal coating to at least a portion of one side of the blank. The paperboard material can be pre-printed with marketing graphics with heat resistant microwaveable inks and/or overprint. Fitting the blank around the container can include completely surrounding the container inside the blank (e.g. as shown in FIG. 17). Fitting the blank around the container can include protruding two edges of the container through cutouts in opposed flaps of the blank (e.g. as shown in FIG. 20). Fitting the blank around the container can include forming at least one insulation space (e.g. insulation spaces 120, 220, 320) between the container and the panels of the blank.

Systems and methods disclosed herein provide consumer features such as the following. The plastic tray does not have to be removed from the carton for cooking. The carton can provide a convenient means of handling the food tray for placement in the oven and removal of the hot tray after cooking, by virtue of the insulation spaces which serve as carrying handles. The integrated food tray and carton, especially in the case of the four-sided embodiments can potentially create a more aesthetically pleasing food vessel. The option of a hinged lid can allow for convenient venting but can also serve as a splatter guard inside the oven. A lid can also provide a means of protecting food and keeping it warm as it is transported from oven to table or desk. The lid can also be used to cover food discreetly when others are near. Also, paperboard and plastic components can be separated for recycling.

The methods and systems of the present disclosure, as described above and shown in the drawings, provide for lidding and containing products such as frozen foods, while providing for ease of handling the products when hot. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A lidding device, comprising: a first panel comprising a lid configured to cover and seal a food container; a second panel foldably connected to the first panel; a third panel comprising a bottom panel opposite the lid, wherein the second panel is foldably connected to the first panel and the third panel; and a fourth panel foldably connected to at least one of the first panel and the third panel, wherein the fourth panel and second panel are configured to at least partially enclose a food container between the second and fourth panels, wherein one portion of the lid extends into the second panel and another portion of the lid extends into a fifth panel foldably connected to the first panel.

2. The lidding device as recited in claim 1, further comprising the food container, sealed to the first panel, wherein the food container is at least partially enclosed between first panel and the third panel and between the second panel and the fourth panel.

3. The lidding device as recited in claim 2, wherein an insulation space is defined between the food container and at least one of the first, second, third, and fourth panels.

4. The lidding device as recited in claim 3, further comprising side flaps foldably connected to at least one of the first and third panels configured for adhering the first panel to the third panel.

5. The lidding device as recited in claim 4, wherein the first panel, second panel, third panel, fourth panel, and side flaps completely enclose the food container.

6. The lidding device as recited in claim 2 further comprising: two opposed panels foldably connected to the first, second, third, and fourth panels, wherein each of the two opposed panels includes a cutout, which receives a respective edge of the food container.

7. The lidding device as recited in claim 1, wherein the first panel includes a venting system including one or more lines of weakness along an edge of the first panel for venting the first panel.

8. The lidding device as recited in claim 1, wherein the first panel further comprises a pull tab for peeling back the first panel along one or more lines of weakness along the first panel edges.

9. The lidding device as recited in claim 1, wherein the second panel is configured for use as a foot that allows the lidding device to stand upright on the second panel.

10. The lidding device as recited in claim 1, wherein at least one of the panels is configured to be printable for printing product identifying material or instructions thereon.

11. The lidding device as recited in claim 1, wherein at least the first panel comprises a thermoplastic or heat sealable coating applied to a food-facing side of the panel.

12. The lidding device as recited in claim 11, wherein the thermoplastic coating comprises a polyolefin dispersion or a polymeric-based film.

13. A method of forming a lidding device, comprising: providing a printable or pre-printed paperboard material; forming a multi-panel blank from the paperboard material, wherein the panels are separated via lines of weakness; applying a thermoplastic heat seal coating to at least a portion of one side of the blank; fitting the blank around a container to surround the container between at least a top panel and an opposed bottom panel and between a first side panel and an opposed second side panel, wherein the top panel defines a lid, extending a portion of the lid into the first side panel and the second side panel; and heat sealing the thermoplastic heat seal coating to the container.

14. The method as recited in claim 13, further comprising applying one or more coatings to the paperboard material.

15. The method as recited in claim 14, wherein the one or more coatings comprises a clay coating.

16. The method as recited in claim 14, wherein applying the one or more coatings comprises applying a thermoplastic heat seal coating to at least a portion of one side of the blank.

17. The method as recited in claim 13, wherein the paperboard material is pre-printed with marketing graphics with heat resistant microwaveable inks and/or overprint.

18. The method as recited in claim 13, wherein fitting the blank around the container includes completely surrounding the container inside the blank.

19. The method as recited in claim 13, wherein fitting the blank around the container includes protruding two edges of the container through cutouts in opposed flaps of the blank.

20. The method as recited in claim 13, wherein fitting the blank around the container includes forming at least one insulation space between the container and the panels of the blank.

21. The lidding device as recited in claim 1 further comprising: a paper container sealed to the food container, wherein the paper container surrounds the food container on at least four sides of the food container, wherein there is an insulation space defined between the food container and the paper container.

* * * * *